US006726574B2

(12) United States Patent
Kim

(10) Patent No.: US 6,726,574 B2
(45) Date of Patent: Apr. 27, 2004

(54) DEVICE FOR GOLF PRACTICE

(76) Inventor: Heung Goo Kim, ByukSan APT 108-303, 1321, Jwa-dong, Haeundae-gu, Busan (KR)

( * ) Notice: Subject to any disclaimer, the term of this patent is extended or adjusted under 35 U.S.C. 154(b) by 0 days.

(21) Appl. No.: 10/431,054

(22) Filed: May 7, 2003

(65) Prior Publication Data

US 2003/0211898 A1 Nov. 13, 2003

(30) Foreign Application Priority Data

May 11, 2002 (KR) ..... 20-2002-0014437

(51) Int. Cl.[7] ..... A63B 69/36
(52) U.S. Cl. ..... 473/139; 473/160; 473/279
(58) Field of Search ..... 473/139, 147, 473/198, 278, 279, 160

(56) References Cited

U.S. PATENT DOCUMENTS 3,430,964 A * 3/1969 Budzinski ..... 473/279
4,279,420 A * 7/1981 Bay et al. ..... 473/270
5,340,111 A * 8/1994 Froelich ..... 473/279
6,033,317 A * 3/2000 Beam ..... 473/279
6,050,901 A * 4/2000 Davis ..... 473/160

* cited by examiner

*Primary Examiner*—Gregory Vidovich
*Assistant Examiner*—Nini F. Legesse
(74) *Attorney, Agent, or Firm*—St. Onge Steward Johnston & Reens LLC

(57) ABSTRACT

A device for golf practice, comprising an adjustable sloping board shaped with a board, formed with a support mat, on the top face of which a golf ball is located, a plurality of leg sets each provided at positions adjacent to four sides of the bottom face of the adjustable sloping board. A shortest leg of each leg set is positioned outermost, and a longest leg is positioned innermost. A guide channel is depressed downward and is extended longitudinally on the top face of the adjustable sloping board. A plurality of receiving holes communicating with the guide channel are formed inwardly at regular intervals. A rotatable member, on which a coupling part coupled with the golf ball is rotatably formed, is received in the receiving hole after being moved along the guide channel. With this configuration, the device for golf practice according to the present invention is advantageous in that a user can practice swing motions while adjusting the slope of the adjustable sloping board variously, as he/she needs, and he/she can also practice them under various slope conditions by moving and fixing the rotatable member coupled with the golf ball along the slope side.

4 Claims, 4 Drawing Sheets

DEVICE FOR GOLF PRACTICE

CROSS-REFERENCES TO RELATED APPLICATIONS

This application claims priority from Korean Patent Application No. 2002–14437 filed on May 11, 2002, in the Korean Intellectual Property Office, the disclosures of which are incorporated herein in their entirety by reference.

BACKGROUND OF THE INVENTION

1. Field of the Invention

The present invention relates, in general, to a device for golf practice and, more particularly, to a device for golf practice wherein the slope and height of a mat for golf practice can be adjusted, thereby allowing a user to practice swing motions in a repeated manner since a golf ball hit by the user is rotated due to the hitting power against the golf ball, and also to practice them under a variety of slope conditions since the gall ball is rotated along the slope face.

2. Description of the Related Art

As well known to those skilled in the art, since beginners who desire to play golf should first learn the elementary motions for swing and putting for a golf game before they go to a golf course, they are in need of fully practicing swing and putting motions in indoor or outdoor golf practice centers, in order to play golf on the golf course. That is, swing motions are significant in playing golf games. To practice swing motions, a golfer generally locates the golf ball on a specific position and then hits the golf ball.

There have been developed a variety of devices for golf practice in order to aid the golfers in practicing swing motions. Korean Utility Model Publication Nos. 1991-180, 1995–4336 and 1996-10601, Korean Utility Model Laid-Open Publication Nos. 1994-7224, 1999-28961 and 1996-13432, and Korean Utility Model Registration No. 230856 have disclosed devices for practicing swing motions. According to the prior art disclosed in the above-mentioned literatures, a golf ball is coupled with a support member in a rotatable manner, the support member being activated as a rotational axis when the golf ball is hit, so as to allow the ball to be rotated, thereby enabling the golfer to practice swing motions in a repeated manner.

However, the above prior arts have the following shortcomings:

First, a support member on which a golf ball is located is flat and the slope thereof cannot be adjusted, whereby the golfer is allowed to practice the swing motions only on the flat surface, but he/she is not allowed to do the swing practice under various slope faces.

Second, the support member to support the golf ball is fixedly mounted on a specific position of the base plate, and thus, it is not possible for the golfer to practice the swing motions under various slope positions.

SUMMARY OF THE INVENTION

Accordingly, the present invention has been made keeping in mind the above problems occurring in the prior art, and an object of the present invention is to provide a device for golf practice with which a golfer is allowed to practice swing motions while variously adjusting the slope of an adjustable sloping board as he/she desires.

Another object of the present invention is to provide a device for golf practice wherein a rotatable member being rotatable by the golfer's hitting with which a golf ball is coupled is rotatably mounted along the slope face, thereby allowing a golfer to practice swing motions under various slope conditions.

In order to accomplish the above objects, the present invention provides a device for golf practice, comprising: an adjustable sloping board having a board shape and formed with a support mat, on a top face of which a golf ball is located; a plurality of leg sets provided at positions adjacent to four sides of a bottom face of the adjustable sloping board, with a shortest leg of each of the leg sets being positioned outermost and a longest leg being positioned innermost; a guide channel depressed downward and extended longitudinally on the top face of the adjustable sloping board; a plurality of receiving holes formed inwardly on the adjustable sloping board at regular intervals while communicating with the guide channel; and a rotatable member on which a coupling part coupled with the golf ball is rotatably provided, the rotatable member being received in one of the receiving holes after being moved along the guide channel.

In the device for golf practice, the adjustable sloping board is formed with a support frame projected downward along an edge of the adjustable sloping board, the support frame is contacted with the leg sets when the leg sets are opened, thereby preventing the leg sets from being opened outwardly excessively.

The rotatable member comprises: a holding part being moved as guided by the guild channel and received in one of the receiving holes; a supporting part taking the shape of a circular cone, the supporting part being coupled with the holding part and projected upward; a coupling part rotatably coupled with the supporting part, on one end of which the golf ball is located, being rotated due to outside hitting force against the golf ball, putting the supporting part as a rotating axis; and a blocking part provided at the top of the supporting part to define a movable range of the coupling part.

With this configuration, the device for golf practice according to the present invention is advantageous in that a golfer can practice swing motions while variously adjusting the slope of an adjustable sloping board as he/she desires, and can also practice them under various slope conditions since the rotatable member coupled with a golf ball is rotatably mounted along the slope face.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE DRAWINGS

Figure 1:
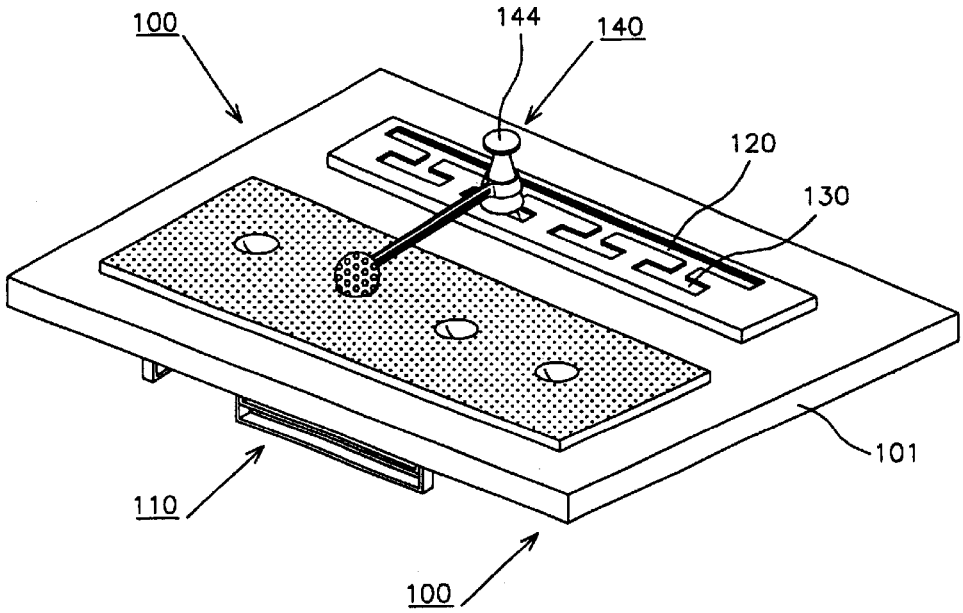
FIG. 1 is a perspective view of a device for golf practice according to the present invention.

Reference should now be made to the drawings, in which the same reference numerals are used throughout the different drawings to designate the same or similar components.

First Embodiment

Figure 2:
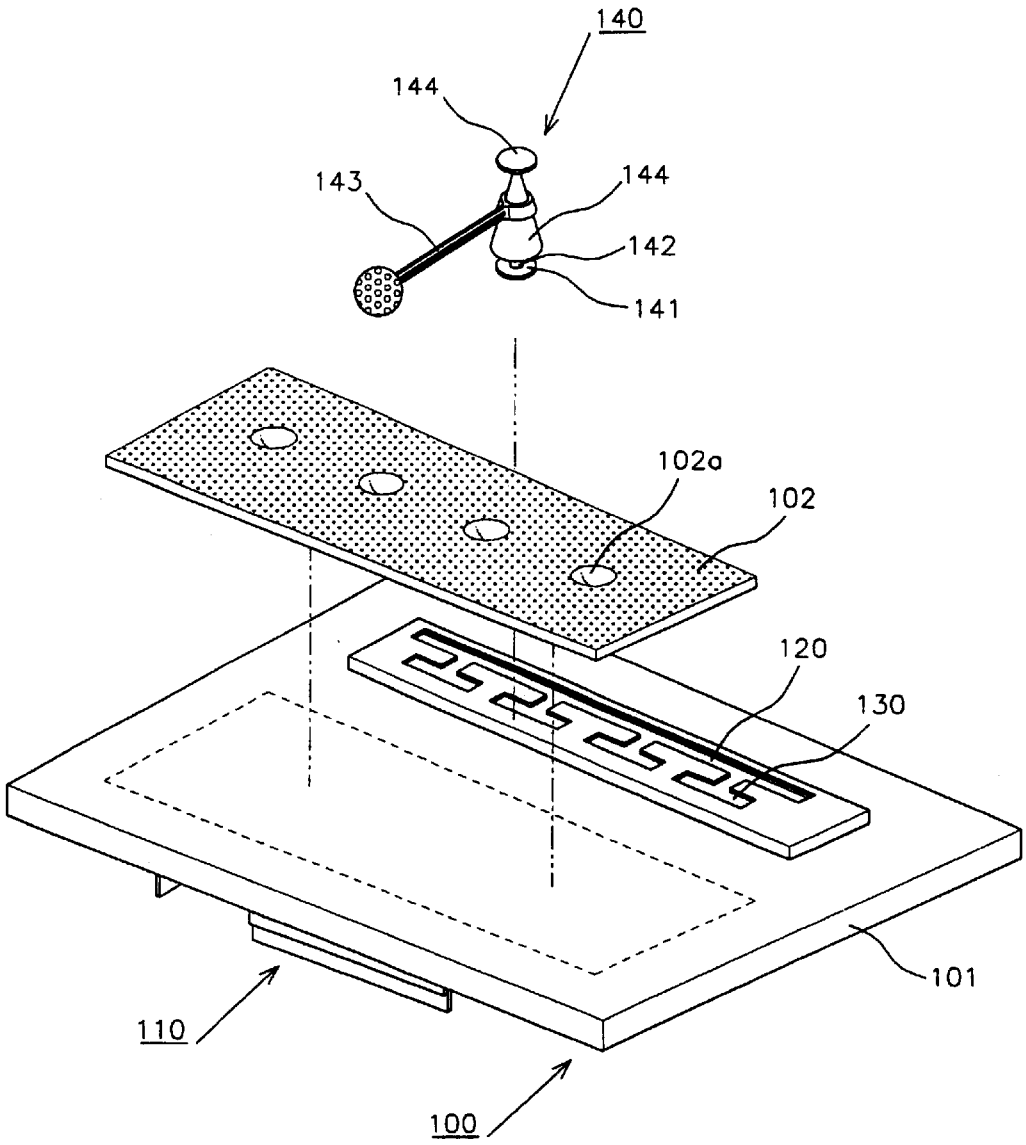
FIG. 2 is an exploded perspective view of the device for golf practice of FIG. 1.
Figure 3:
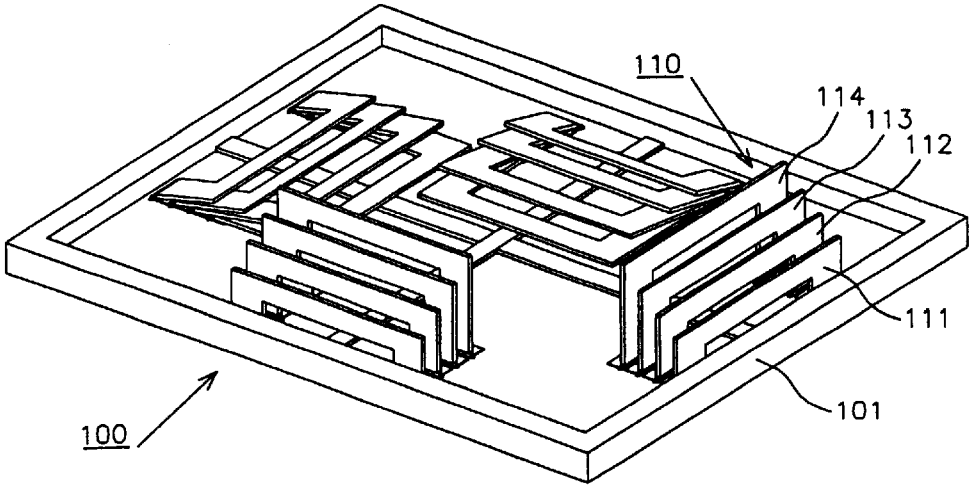
FIG. 3 is a perspective view showing a bottom face of an adjustable sloping board included in the device for golf practice, according to a first embodiment of the present invention.

FIG. 1 is a perspective view of a device for golf practice according to the present invention, FIG. 2 is an exploded perspective view of the device for golf practice of FIG. 1, and FIG. 3 is a perspective view showing a bottom face of an adjustable sloping board included in the device according to a first embodiment of the present invention.

As shown therein, the device for golf practice according to the present invention comprises an adjustable sloping board 100, a plurality of folding leg sets 110, a guide channel 120, receiving holes 130 and a rotatable member 140.

The adjustable sloping board 100 made of steel, taking the shape of a rectangle, is formed with a support frame 101 being protrudingly extended downward along the edge of the adjustable sloping board 100.

The support frame 101 takes the shape of a bar having a rectangular cross-section, and is formed along the edge of the adjustable sloping board 100. Where the leg sets 110 to be described later are opened, the support frame 101 supports the leg sets 110, thereby preventing the leg sets 110 from being outwardly opened excessively and at the same time supporting the leg sets 110.

On the top face of the adjustable sloping board 100 is formed a support mat 102 on which a golf ball is located, the support mat 102 being made of plastics in order to provide an effect of natural lawn. On the support mat 102 are formed a plurality of depressions 102*a* depressed downward to a predetermined depth. Since the golf ball is located on the depression 102*a* of the support mat 102, the golf ball is not moved at random even through the adjustable sloping board 100 is inclined.

Each of the leg sets 110 is comprised of four legs, and each leg of the leg sets 110 takes the form of "□", and the leg sets 110 are positioned adjacent to four sides on the rectangular bottom face of the adjustable sloping board 100, respectively.

The legs of each leg set 110 are mounted rotatably by hinges on the bottom face of the adjustable sloping board 100, under which the legs are opened or folded, as desired.

The legs of each leg set 110 have different lengths, and are placed to be adjacent one another. By selectively opening a desired leg set 110, the slope of the adjustable sloping board 100 can be adjusted by means of the open leg set 110.

Of each leg set 110, a first leg 111 having the shortest length is outermost mounted by a hinge on the bottom face of the adjustable sloping board 100, whereby it can be rotatably opened and folded. Adjacent to the first leg 111, a second leg 112 comparatively longer than the first leg 111 is mounted rotatably by another hinge on the bottom face of the adjustable sloping board 100. Adjacent to the second leg 112 is rotatably mounted a third leg 113 comparatively longer than the second leg 112. Also adjacent to the third leg 113 is mounted a fourth leg 114 comparatively longer than the third leg 113, in a rotatable manner. Herein, it has been described that each leg set 110 comprises four legs, for the sake of convenience; however, the number of legs of each leg set 110 may increase if the user wants minute adjustment of the slope, which will also be covered in the scope of the present invention. A magnet may be mounted on each leg of each leg set 110 so as to allow it to be closely attached to the bottom face of the adjustable sloping board 100 by the magnetic force thereof where the leg set 110 is closed.

Where the leg set 110 is opened, the first leg 111 is first opened and the outer surface of the first leg 111 is contacted with the support frame 101, thereby preventing the leg set 110 to be outwardly opened excessively.

Accordingly, where the adjustable sloping board 100 is located on the ground, the slope of the adjustable sloping board 100 can be adjusted by opening or folding the leg sets 100.

The guide channel 120 is formed longitudinally on the top face of the adjustable sloping board 100, being depressed downwardly, along which a holding part 141 of the rotatable member 140 to be described later is rotated.

A plurality of receiving holes 130 communicating with the guide channel 130 are formed inwardly toward the adjustable sloping board 100 at regular intervals, being depressed downwardly, through which the holding part 141 of the rotatable member 140 to be described later is inserted to hold the rotatable member 140.

Where the user desires to move the rotatable member 140, the rotatable member 140 is moved along the guide channel 120 and the holding part 141 of the rotatable member 140 is inserted into a receiving hole 130, thereby allowing the rotatable member 140 to be stably located at a specific position.

The rotatable member 140 is comprised of the holding part 141, a supporting part 142, a coupling part 143 and a blocking part 144.

The holding part 141 takes the form of a circular plate, being moved along the guide channel 120 and then received in the receiving hole 130, thereby functioning to determine a location of the rotatable member 140 as a whole.

The supporting part 142 takes the form of a circular cone, being integrally combined with the holding part 141 while being projected from the top of the holding part 141.

The coupling part 143 takes the form of a bar with a specified length. On one end of the coupling part 143 is formed a ring into which the supporting part 142 is inwardly inserted, thereby being coupled with the supporting part 142 in a rotatable manner. The other end of the coupling part 143 is protrudingly extended toward the support mat 102, thereby allowing a golf ball to be located on the depression 102*a* of the support mat 102.

The blocking part 144 takes the form of a circular disc, being provided at the top of the supporting part 142, whereby the coupling part 143 is prevented from being deviated toward the top of the supporting part 142 due to the centrifugal force, when the golf ball is hit and the coupling part 143 is rotated.

The supporting part 142 is formed in the shape of a circular cone, whereby the coupling part 143 is rotated upward due to the centrifugal force to some distance where the coupling part 143 is rotated, and the coupling part 143 is smoothly rotated in the course of rotation.

Second Embodiment

Figure 4:
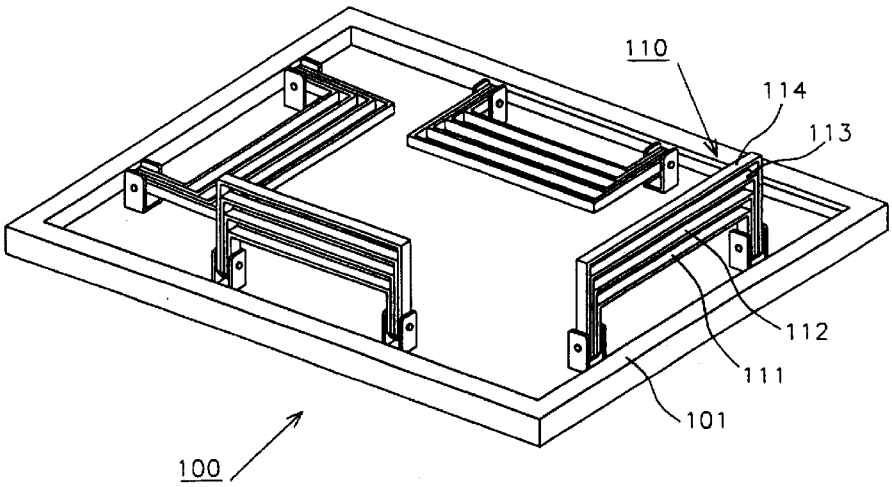
FIG. 4 is a perspective view showing a bottom face of an adjustable sloping board included in the device for golf practice, according to a second embodiment of the present invention.

FIG. 4 is a perspective view showing the bottom face of an adjustable sloping board according to a second embodiment of the present invention. The second embodiment of the present invention has the identical elements to the first embodiment, except for the combination manner of the leg sets 110.

The leg sets 110 each consists of four legs, and each leg takes the form of "⊂", and the legs of each leg set 110 are rotatably mounted by two hinges each having the same shaft. In such a case, the leg sets 110 are placed at positions adjacent to the four sides of the bottom face of the adjustable sloping board 100.

The leg sets 110 take the shape that one leg is laid on a top of another and the legs are coupled one another rotatably by the hinges each having the same shaft.

A first leg 111 of each leg et 110 having the shortest length is formed innermost, and a second leg 112 comparatively longer than the first leg 111 is formed, enclosing the outer surface of the first leg 111. A third leg 113 comparatively longer than the second leg 112 is formed, enclosing the outer surface of the second leg 112, and a fourth leg 114 comparatively longer than the third leg 113 is formed, enclosing the outer surface of the third leg 113. The legs of each leg set 110 are coupled together by two hinges each having the same shaft.

Accordingly, the slope of the adjustable sloping board 100 is adjusted by selectively opening desired leg sets 110 in a rotatable manner where the adjustable sloping board 100 is put on the ground.

The second embodiment of the present invention has shown the same elements as the first embodiment thereof, except that the legs of each leg set are hinged to the adjustable sloping board by use of two hinges.

With this configuration, the device for golf practice according to the present invention has the following effects:

Where a user desires to practice swing motions, he/she can adjust the slope of the adjustable sloping board 100 by selectively opening any of the leg sets 110 and locating the adjustable sloping board 100 on the ground.

Then, he/she moves the rotatable member 140 along the guide channel to thereby allow it to be located on a predetermined position. Under the circumstances, he/she adjusts the coupling part 143 so that a golf ball put on the other side of the coupling part 143 of the rotatable member 140 is located on the depression 102*a* of the support mat 102. Thereafter, the user hits the golf ball, and the coupling part 143 is rotated, putting the supporting part 142 as a rotating axis, according to the hitting of the ball, and the ball is rotated instead of being flied.

If rotation of the coupling part 143 stops, the user can again hit the ball, thereby allowing him/her to practice the swing motions in a repeated manner.

Where the user desires to change his swing position, he/she moves again the rotatable member 140 along the guide channel 120 and fixes it in the receiving hole 130, thereby practicing the swing motions repeatedly.

If the user desires to adjust the slope of the adjustable sloping board 100, he/she selectively opens any of the leg sets 110 formed on the bottom face of the adjustable sloping board 100 and determines the slope of the adjustable sloping board 100 again, thereby repeats the swing practice.

As described above, the present invention provides a device for golf practice with which a user is allowed to practice swing motions by adjusting the slope of the adjustable sloping board variously as he/she needs, and also to practice them under various slope conditions by moving and fixing the rotatable member coupled with a golf ball and then hitting the ball.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A device for golf practice, comprising:

an adjustable sloping board having a board shape and formed with a support mat, on a top face of which a golf ball is located;

a plurality of leg sets provided at positions adjacent to four sides of a bottom face of the adjustable sloping board, with a shortest leg of each of the leg sets being positioned outermost and a longest leg being positioned innermost;

a guide channel depressed downward and extended longitudinally on the top face of the adjustable sloping board;

a plurality of receiving holes formed inwardly on the adjustable sloping board at regular intervals while communicating with the guide channel; and a rotatable member on which a coupling part coupled with the golf ball is rotatably provided, the rotatable member being received in one of the receiving holes after being moved along the guide channel.

2. The device for golf practice according to claim 1, wherein said rotatable member comprises:

a holding part being moved as guided by the guild channel and received in one of the receiving holes;

a supporting part taking the shape of a circular cone, the supporting part being coupled with the holding part and projected upward;

a coupling part rotatably coupled with the supporting part, on one end of which the golf ball is located, being rotated due to outside hitting force against the golf ball, putting the supporting part as a rotating axis; and a blocking part provided at the top of the supporting part to define a movable range of the coupling part.

3. The device for golf practice according to claim 1, wherein said adjustable sloping board is formed with a support frame projected downward along an edge of the adjustable sloping board, the support frame is contacted with said leg sets when the leg sets are opened, thereby preventing the leg sets from being opened outwardly excessively.

4. The device for golf practice according to claim 3, wherein said rotatable member comprises:

a holding part being moved as guided by the guild channel and received in one of the receiving holes;

a supporting part taking the shape of a circular cone, the supporting part being coupled with the holding part and projected upward;

a coupling part rotatably coupled with the supporting part, on one end of which the golf ball is located, being rotated due to outside hitting force against the golf ball, putting the supporting part as a rotating axis; and a blocking part provided at the top of the supporting part to define a movable range of the coupling part.

* * * * *